United States Patent [19]

DiFazio

[11] Patent Number: 4,972,640

[45] Date of Patent: Nov. 27, 1990

[54] WINDOW TRIM ASSEMBLY WITH MOUNTING CLIP

[75] Inventor: Joseph DiFazio, Troy, Mich.

[73] Assignee: ABC Investments, Inc., Detroit, Mich.

[21] Appl. No.: 375,612

[22] Filed: Jul. 5, 1989

[51] Int. Cl.[5] ..... E06B 1/56

[52] U.S. Cl. ..... 52/211; 52/217; 52/713; 52/714

[58] Field of Search ..... 52/394, 395, 211, 213, 52/217, 359, 714, 712, 713; 49/495, 484, 485; 24/580, 583

[56] References Cited

U.S. PATENT DOCUMENTS

| | | | |
|---|---|---|---|
| 2,902,727 | 9/1959 | Samolis | 52/217 |
| 3,217,921 | 11/1965 | Frehse | 49/495 |
| 3,378,958 | 4/1968 | Parks | 49/495 |
| 3,862,535 | 1/1975 | Byssing | 52/714 |
| 3,864,889 | 2/1975 | Hobbs | 52/714 |
| 3,943,679 | 3/1976 | Dissinger | 49/505 |
| 4,119,325 | 10/1978 | Oakley | 49/495 |
| 4,407,100 | 10/1983 | Huelsekopf | 52/475 |

*Primary Examiner*—John E. Murtagh

*Attorney, Agent, or Firm*—Brooks & Kushman

[57] ABSTRACT

A window trim assembly (10) is disclosed as having a window surround assembly (12), a casing (14), a seal (16) and mounting clips (18) cooperatively connected to securely and conveniently attach a preassembled window trim assembly to a window frame assembly or a similar apparatus.

33 Claims, 2 Drawing Sheets

WINDOW TRIM ASSEMBLY WITH MOUNTING CLIP

TECHNICAL FIELD

This invention relates to a preassembled window trim assembly having mounting clips for securing it to a window frame assembly.

BACKGROUND ART

A typical method for trimming a window includes many separate steps: measuring window surround and casing material, cutting the material at proper angles to proper lengths, fitting the cut pieces around a wall opening, holding them in place and securing them to the surrounding wall with nails or the like. Because wall and window construction is not always completed accurately, and there can be additional variations in structural relationships caused by postconstruction warpage and settling, cutting and fitting the trim pieces is not always a straightforward task. Compensations must be made for such inaccuracies and variations, and these compensations result in lost time and money. Failure to make necessary compensations, however, often results in a finished product of inferior quality.

In addition to preparing and installing the window trim material, it must also be painted or stained and varnished. These processes also take time and incur substantial cost. Adjacent projects may also have to be delayed until the window trim finish is dry.

While the foregoing window trimming method does work, it does not provide a means of window trim installation that is as convenient and quick as that using the present invention, which can simply be slipped into place as a preassembled and prefinished unit.

DISCLOSURE OF THE INVENTION

An object of the present invention is to provide a preassembled window trim assembly including a window surround, a casing, an insulating seal and a plurality of mounting clips to attach the window trim assembly to a window frame assembly or a similar apparatus to beautify and insulate a window opening.

Another object is to provide an improved mounting clip to securely and conveniently attach a preassembled window trim assembly to members of a window frame assembly or a similar apparatus.

Yet another object is to provide a mounting clip that is conveniently and accurately attachable to a window trim assembly.

Still another object is to provide a mounting clip to securely and conveniently attach a preassembled window trim assembly to window frame assembly members wherein the mounting clip is capable of accommodating window frame assembly members having a variety of thicknesses and having clip engagement surfaces that are disposed at a variety of distances from the window trim assembly.

Another object is to provide a mounting clip having pawls to securely and conveniently attach a preassembled window trim assembly to a window frame assembly where the differences in the distances of the clip engagement surfaces of the window frame assembly members from the window trim assembly may be less than the distances between adjacent mounting clip pawls.

In carrying out the foregoing and other objects, the window trim assembly of the present invention includes a window surround assembly, a casing assembly attached to the surround assembly, and mounting clips secured to the surround assembly to secure the window trim assembly to a window frame assembly.

In the preferred construction of the window trim assembly, the window surround assembly includes a surround header, a surround stool and a pair of surround sides. Each of the surround sides extends between and is connected at right angles to different ends of the surround header and the surround stool to form a rectangular assembly.

The casing assembly includes a casing header, a casing apron and a pair of casing sides. Each of the casing sides extends between and is connected at right angles to different ends of the casing header and the casing apron to form a rectangular assembly, which is secured to the surround assembly. The mounting clips are also secured to the surround assembly. A seal, such as an adhesive-backed foam, is also attached to the surround assembly to serve as a thermal and a moisture barrier between the window trim assembly and the window frame assembly.

Each of the mounting clips of the present invention includes a resilient backing plate. The backing plate is effectively divided into a spring portion and a mounting portion. Elongated pawls are secured to the spring portion for engaging a member of a window frame assembly or a similar apparatus, the mounting portion being left free to facilitate its attachment to the window trim assembly.

In one embodiment of the present invention, each of the mounting clips includes a resilient backing plate having a mounting portion, to facilitate securing the mounting clip to the window trim casing, proximate a first end of the backing plate and a spring portion proximate a second end of the backing plate. A plurality of elongated pawls are disposed on one side of the spring portion of the backing plate to facilitate securing the mounting clip to a frame member of the window frame assembly.

The pawls are disposed parallel to and spaced from each other and parallel to and proximate the second end of the backing plate. The pawls extend away from the backing plate at an acute angle and in a direction away from the second end of the backing plate. The pawls are spaced from each other a distance greater than the thickness of a typical frame member with which the pawls engage.

The mounting clip also has a positioning stop secured to the backing plate to facilitate positioning the mounting clip in preparation for securing the latter to the window trim assembly. The positioning stop is disposed parallel to the pawls and proximate a substantially central line separating the spring and mounting portions of the backing plate. The positioning stop extends at right angles from the same side of the backing plate as do the pawls.

In the preferred construction of the mounting clip, the resilient backing plate has a mounting portion proximate a first end of the backing plate and a spring portion proximate a second end of the backing plate. The mounting portion facilitates securing the mounting clip to the window trim assembly with screws, staples or the like. The spring portion of the backing plate is bifurcated, having a spring slot extending from a substantially central point along the second end of the backing plate to a similar point along a line separating the spring portion from the mounting portion of the backing plate. The spring slot separates the spring portion into, and defines, a first spring segment and a second spring segment.

A plurality of elongated pawls are secured to one side of each of the spring segments of the backing plate to facilitate securing the mounting clip to a frame member of the window frame assembly. The pawls are disposed parallel to and spaced from each other and parallel to and proximate the second end of the backing plate. The pawls extend from the backing plate at an acute angle and in a direction away from the second end of the backing plate. The pawls disposed on each of the spring segments are spaced from each other a distance greater than the thickness of a typical frame member with which the pawls engage.

The pawls extending from the first spring segment are located at distances from the second end of the backing plate that are intermediate with respect to the distances from the second end of the backing plate at which the pawls extending from the second segment of the spring portion are located.

As in the first embodiment, the mounting clip has a positioning stop secured to the backing plate to facilitate positioning the mounting clip in preparation for securing the latter to the window trim assembly. The positioning stop is disposed parallel to the pawls and proximate a substantially central line separating the spring and mounting portions of the backing plate. The positioning stop extends at right angles from the same side of the backing plate as do the pawls.

The objects, features and advantages of the present invention are readily apparent from the following detailed description of the best mode for carrying out the invention when taken in connection with the accompanying drawings thereof in which like reference numerals indicate corresponding parts in all the views.

BEST MODE FOR CARRYING OUT THE INVENTION

Figure 1:
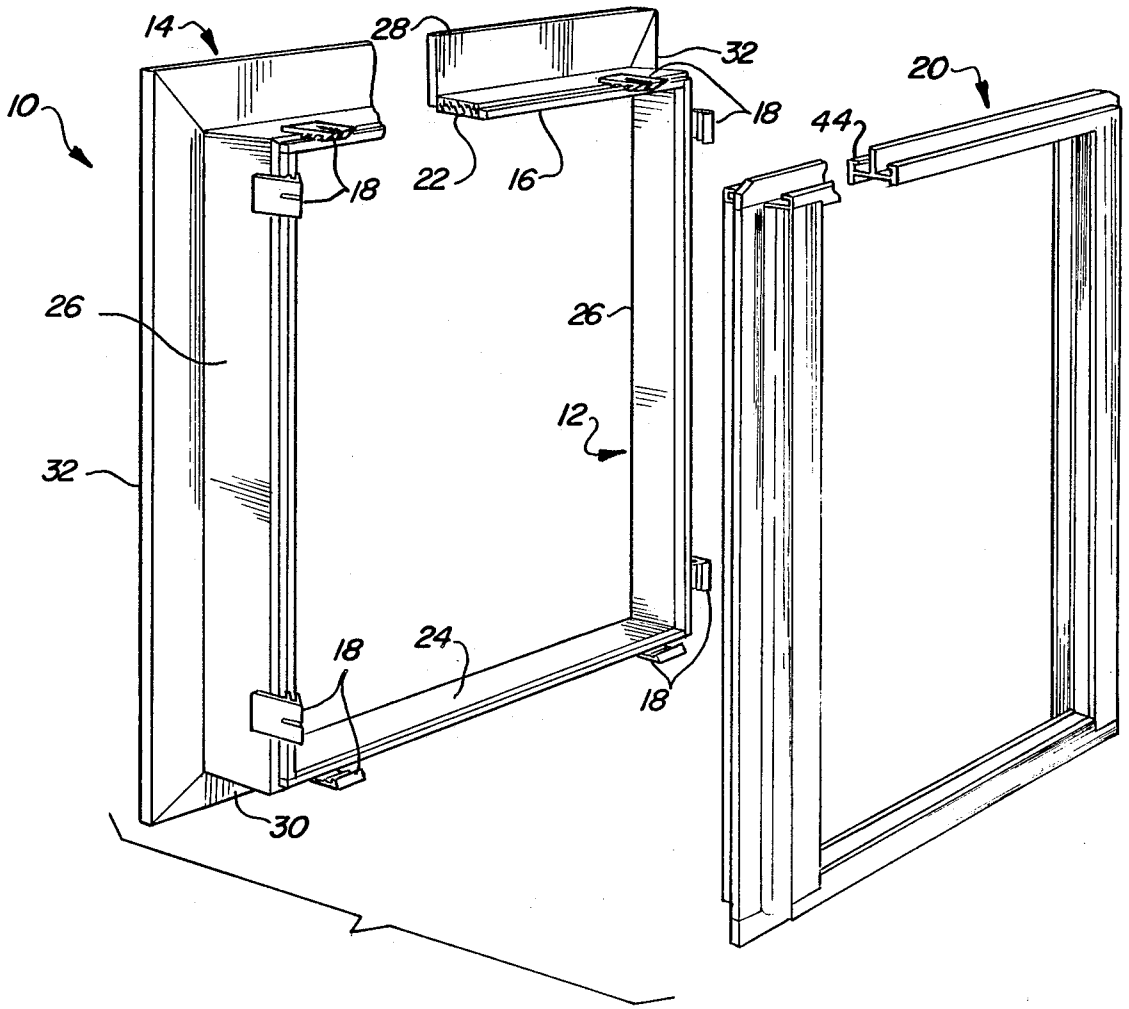
FIG. 1 is a view illustrating the window trim assembly of the present invention.
Figure 2:
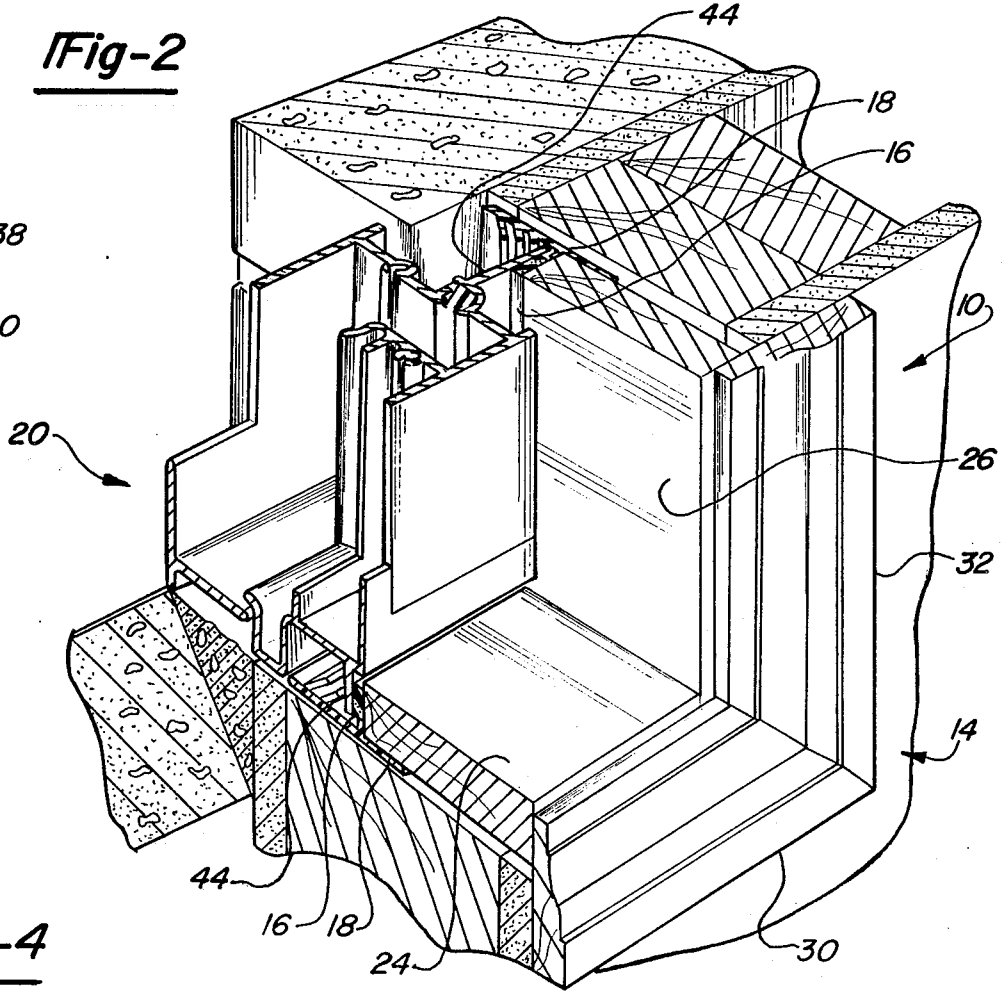
FIG. 2 is a fragmentary perspective view illustrating the preferred construction of the window trim assembly shown attached to a typical window frame.

With reference to FIGS. 1 and 2, a window trim assembly constructed in accordance with the present invention is generally indicated by reference numeral 10. The window trim assembly 10 includes a window surround assembly generally indicated by reference numeral 12, a casing assembly generally indicated by reference numeral 14 attached to the surround assembly 12, and mounting clips 18 secured to the surround assembly 12 to secure the window trim assembly 10 to a window frame assembly generally indicated by reference numeral 20.

In the preferred construction of the window trim assembly 10, the window surround assembly 12 includes a surround header 22, a surround stool 24 and a pair of surround sides 26. Each of the surround sides 26 extends between and is connected at right angles to different ends of the surround header 22 and the surround stool 24 to form a rectangular assembly.

The casing assembly 14 includes a casing header 28, a casing apron 30 and a pair of casing sides 32. Each of the casing sides 32 extends between and is connected at right angles to different ends of the casing header 28 and the casing apron 30 to form a rectangular assembly, which is secured to the surround assembly 12. The mounting clips 18 are also secured to the surround assembly 12. A seal 16, such as an adhesive-backed foam, is also attached to the surround assembly 12 to serve as a thermal and a moisture barrier between the window trim assembly 10 and the window frame assembly 20.

The window surround assembly 12 and the casing assembly 14 are preassembled and prefinished, and the two assemblies are secured together by well-known mechanical or chemical means to form, with the mounting clips, a complete window trim assembly 10. The members forming the completed window trim assembly 10 may be fabricated from any one of, or from a combination of, a number of materials such as wood or plastic.

Figure 3:
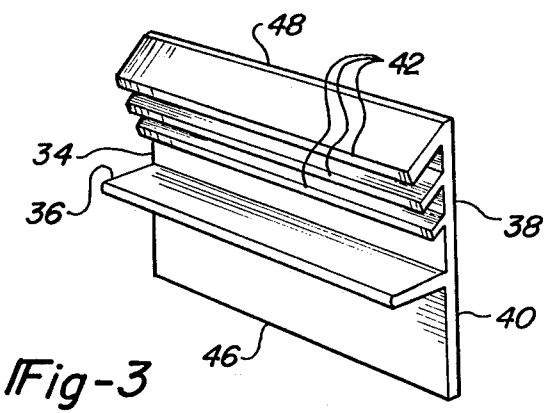
FIG. 3 is a perspective view illustrating an embodiment of the mounting clip.
Figure 4:
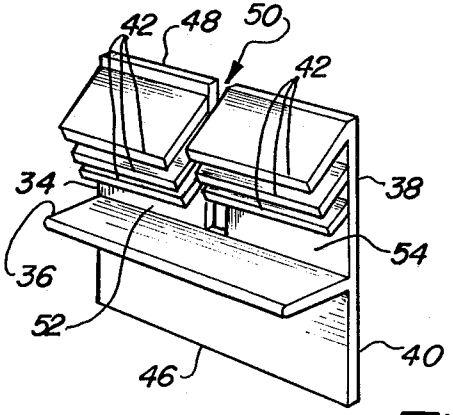
FIG. 4 is a perspective view illustrating another embodiment of the mounting clip of FIG. 3.

As illustrated in FIGS. 3 and 4, each of the mounting clips 18 of the present invention includes a resilient backing plate 34. The backing plate 34 is effectively divided into a spring portion 38 and a mounting portion 40. Elongated pawls 42 are secured to the spring portion 38 for engaging a member of a window frame assembly 20 or a similar apparatus, the mounting portion 40 being left free to facilitate its attachment to a window trim assembly 10 shown in FIGS. 1 and 2.

In the preferred construction of the mounting clip 18, the resilient backing plate 34 has a mounting portion 40 proximate a first end 46 of the backing plate 34 and a spring portion 38 proximate a second end 48 of the backing plate 34. The mounting portion 40 facilitates securing the mounting clip 18 to the window trim assembly 10 with screws, staples or the like (not shown). The spring portion 38 of the backing plate 34 is bifurcated, having a spring slot generally indicate by reference numeral 50 in FIG. 4 extending from a substantially central point along the second end 48 of the backing plate 34 to a similar point along a line separating the spring portion 38 from the mounting portion 40 of the backing plate 34. The spring slot 50 separates the spring portion 38 into, and defines, a first spring segment 52 and a second spring segment 54.

A plurality of elongated pawls 42 are secured to one side of each of the spring segments 52 and 54 of the backing plate 34 to facilitate securing the mounting clip 18 to a frame member 44 of the window frame assembly 20. The pawls 42 are disposed parallel to and spaced from each other and parallel to and proximate the second end 48 of the backing plate 34. The pawls 42 extend from the backing plate 34 at an acute angle and in a direction away from the second end 48 of the backing plate 34. The pawls 42 disposed on each of the spring segments 52 and 54 are spaced from each other a distance greater than the thickness of a typical frame member 44 with which the pawls 42 engage.

The pawls 42 extending from the first spring segment 52 are located at distances from the second end 48 of the backing plate 34 that are intermediate with respect to the distances from the second end 48 of the backing plate 34 at which the pawls 42 extending from the second segment 54 of the spring portion 38 are located.

The mounting clip 18 also has a positioning stop 36 secured to the backing plate 34 to facilitate positioning the mounting clip 18 in preparation for securing the latter to the window trim assembly 10. The positioning stop 36 is disposed parallel to the pawls 42 and proximate a substantially central line effectively separating the spring portion 38 and the mounting portion 40 of the backing plate 34. The positioning stop 36 extends at right angles from the same side of the backing plate 34 as do the pawls 42.

During the fabrication of the window trim assembly 10, a mounting clip 18 can be accurately aligned and positioned by sliding its mounting portion 40 along an appropriate surface of the window surround assembly 12 until the positioning stop 36 abuts an associated edge of the surround assembly 12. The mounting clip 18 can then be secured to the surround assembly 12 mechanically with screws, staples or the like or chemically with an adhesive.

When a wall opening fitted with a window frame is to be trimmed, the window trim assembly 10 is simply pressed into place. Due to the resilience of the backing plate 34 of each of the mounting clips the backing plate 34 flexes sufficiently to allow the pawls 42 to slip past and then snap into engagement with a window frame member 44, thus securing the window trim assembly 10 in position. If desired, members of the window surround assembly 12 and the casing assembly 14 can be additionally secured to the associated jack studs and wall with well-known means such as nails or staples.

The unique design and configuration of the mounting clip 18 enable it to compensate for a reasonable range of irregularities in a wall and window frame and in the thickness and disposition of an engaged window frame member 44. Since the length of each pawl 42 is less than that of an adjoining pawl disposed closer to the second end 48 of the backing plate 34, window frame members 44 having thicknesses even greater than the spaces between adjacent pawls 42 can be effectively accommodated and engaged.

Since the pawls 42 extending from the first spring segment 52 are located at distances from the second end 48 of the backing plate 34 that are intermediate with respect to the distances from the second end 48 of the backing plate 34 at which the pawls 42 extending from the second segment 54 of the spring portion 38 are located, window frame members 44 having locations that differ by amounts even less than the distance between adjacent pawls 42 on either of the spring segments 52 or 54 can also be effectively accommodated and engaged.

In the preferred construction, the mounting clip 18 is made of a plastic material; and the backing plate 34, the pawls 42 and the positioning stop 36 are one continuous piece. Each spring segment 52 and 54 of the backing plate 34 is 0.625 inch (16 mm) wide, and the spring slot separating them is 0.062 inch (1.6 mm) wide. The pawls 42 respectively extend 0.070 inch (1.8 mm), 0.140 inch (3.6 mm) and 0.210 inch (5.4 mm) from the spring segments 52 and 54 at 45-degree angles thereto, the shortest pawl being the closest to the positioning stop 36.

The engaging edges of the pawls 42 on the first spring segment 52 are respectively 0.218 inch (5.5 mm), 0.342 inch (8.7 mm) and 0.466 inch (11.8 mm) from the engaging surface of the position stop 36. The engaging edges of the pawls 42 on the second spring section 54 are respectively 0.280 inch (7.1 mm), 0.404 inch (10.3 mm) and 0.528 inch (13.4 mm) from the engaging surface of the positioning stop 36. The pawl that extends farthest from the second spring segment 54 is disposed at the second end 48 thereof, and the pawl that extends farthest from the first spring segment 52 is spaced from the second end 48 thereof to provide an intermediate spacing of the pawls 42 disposed on the first spring segment 52 with respect to the pawls 42 disposed on the second spring segment 54.

While the best mode for carrying out the invention has been described in detail, those familiar with the art to which this invention relates will recognize various alternative designs and embodiments for practicing the invention as disclosed by the following claims.

What is claimed is:

1. A mounting clip to secure a preassembled window trim assembly to a window frame assembly having a frame member, the mounting clip comprising:

a resilient backing plate having a mounting portion, to facilitate securing the mounting clip to the window trim assembly, proximate a first end of said backing plate and a spring portion proximate a second end of said backing plate; and a plurality of elongated pawls secured to one side of said spring portion of said backing plate, to facilitate securing the mounting clip to the frame member of the window frame assembly, said pawls being disposed parallel to and spaced from each other and parallel to and proximate said second end of said backing plate, said pawls extending away from said backing plate at an acute angle and in a direction away from said second end of said backing plate, said pawls being spaced from each other and of varying lengths to compensate for irregularities in the frame member of the window frame assembly.

2. A mounting clip according to claim 1, further including a positioning stop secured to said backing plate, to facilitate positioning the mounting clip in preparation for securing the mounting clip to the window trim casing, said positioning stop being disposed parallel to said pawls and proximate a substantially central line separating said spring and mounting portions of said backing plate, said positioning stop extending at substantially right angles from the same side of said backing plate as do said pawls.

3. A mounting clip according to claim 2, wherein each of said pawls is equally spaced from each adjacent pawl.

4. A mounting clip to secure a preassembled window trim assembly to a window frame assembly having a frame member, the mounting clip comprising:

a resilient backing plate having a mounting portion, to facilitate securing the mounting clip to the window trim casing, proximate a first end of said backing plate and a spring portion proximate a second end of said backing plate, said spring portion of said backing plate being bifurcated to define a spring slot extending from a substantially central point along said second end of said backing plate to a similar point along a line separating said spring portion from said mounting portion of said backing plate, said spring slot separating said spring portion into, and defining, a first spring segment and a second spring segment;

a plurality of elongated pawls secured to one side of each of said spring segments of said backing plate to facilitate securing the mounting clip to the frame member of the window frame assembly, said pawls being disposed parallel to and spaced from each other and parallel to and proximate said second end of said backing plate, said pawls extending away from said backing plate at an acute angle and in a direction away from said second end of said backing plate, said pawls being spaced from each other a distance greater than the thickness of the frame member of the window frame assembly.

5. A mounting clip according to claim 4, wherein said pawls extending from said first spring segment are disposed at distances from said second end of said backing plate that are intermediate with respect to the distances from said second end of said backing plate at which said pawls extending from said second segment of said spring portion are disposed.

6. A mounting clip according to claims 4 or 5, further including a positioning stop secured to said backing plate to facilitate positioning the mounting clip in preparation for securing the mounting clip to the window trim casing, said positioning stop being disposed parallel to said pawls and proximate a substantially central line separating said spring and mounting portions of said backing plate, said positioning stop extending at right angles from the same side of said backing plate as do said pawls.

7. A mounting clip according to claim 6, wherein each of said pawls extending from each of said segments is equally spaced from each adjacent pawl extending from the same one of said segments.

8. A window trim assembly attachable t a window frame assembly, having a frame member, to trim around and within a structural window opening, the window trim assembly comprising:

a window surround assembly including a surround header, a surround stool and a pair of surround sides, each of said surround sides extending between and being connected at right angles to different ends of said surround header and said surround stool to form a rectangular assembly therewith;

a casing assembly including a casing header, a casing apron and a pair of casing sides, each of said casing sides extending between and being connected at right angles to different ends of said casing header and said casing apron to form a rectangular assembly therewith, said casing assembly being secured to said surround assembly; and a plurality of mounting clips secured to said surround assembly for securing the window trim assembly to said window frame assembly, at least some of said clips having a plurality of pawls extending from said surround assembly toward the frame member of said window frame assembly, said pawls being spaced from each other and being of varying lengths to compensate for irregularities in the frame member when the window trim assembly is secured to said window frame assembly.

9. A window trim assembly according to claim 8, wherein each of said mounting clips includes:

a resilient backing plate having a mounting portion to facilitate securing said mounting clip to the window trim assembly, proximate a first end of said backing plate and a spring portion proximate a second end of said backing plate;

said plurality of pawls being elongated and secured to one side of said spring portion of said backing plate, to facilitate securing said mounting clip to the frame member of the window frame assembly, said pawls being disposed parallel to and spaced from each other and parallel to and proximate said second end of said backing plate, said pawls extending away from said backing plate at an acute angle and in a direction away from said second end of said backing plate, said pawls being spaced from each other a distance greater than the thickness of the frame member of the window frame assembly.

10. A window trim assembly according to claim 9, wherein said mounting clips further include a positioning stop secured to said backing plate to facilitate positioning said mounting clip in preparation for securing said mounting clip to the window trim casing, said positioning stop being disposed parallel to said pawls and proximate a substantially central line separating said spring and mounting portions of said backing plate, said positioning stop extending at right angles from the same side of said backing plate as do said pawls.

11. A window trim assembly according to claim 10, wherein each of said pawls is equally spaced from each adjacent pawl.

12. A window trim assembly attachable to a window frame assembly, having a frame member, to trim around and within a structural window opening, the window trim assembly comprising:

a window surround assembly including a surround header, a surround stool and a pair of surround sides, each of said surround sides extending between and being connected at right angles to different ends of said surround header and said surround stool to form a rectangular assembly therewith;

a casing assembly including a casing header, a casing apron and a pair of casing sides, each of said casing sides extending between and being connected at right angles to different ends of said casing header and said casing apron to form a rectangular assembly therewith, said casing assembly being secured to said surround assembly; and a plurality of mounting clips secured to said surround assembly;

wherein each of said mounting clips include:

a resilient backing plate having a mounting portion, to facilitate securing said mounting clip to the window trim casing, proximate a first end of said backing plate and a spring portion proximate a second end of said backing plate, said spring portion of said backing plate being bifurcated to define a spring slot extending from a substantially central point along said second end of said backing plate to a similar point along a line separating said spring portion from said mounting portion of said backing plate, said spring slot separating said spring portion into, and defining, a first spring segment and a second spring segment; and a plurality of elongated pawls secured to one side of each of said spring segments of said backing plate to facilitate securing said mounting clip to the frame member of the window frame assembly, said pawls being disposed parallel to and spaced from each other and parallel to and proximate said second end of said backing plate, said pawls extending away from said backing plate at an acute angle and in a direction away from said second end of said backing plate, said pawls being spaced from each other a distance greater than the thickness of the frame member of the window frame assembly.

13. A window trim assembly according to claim 11, wherein said pawls extending from said first spring segment are disposed at distances from said second end of said backing plate that are intermediate with respect to the distances from said second end of said backing plate at which said pawls extending from said second segment of said spring portion are disposed.

14. A window trim assembly according to claim 12 or 13, further including a positioning stop secured to said backing plate to facilitate positioning said mounting clip in preparation for securing said mounting clip to the window trim casing, said positioning stop being disposed parallel to said pawls and proximate a substantially central line separating said spring and mounting portions of said backing plate, said positioning stop extending at right angles from the same side of said backing plate as do said pawls.

15. A window trim assembly according to claim 14 wherein each of said pawls extending from each of said segments is equally spaced from each adjacent pawl extending from the same one of said segments.

16. A window trim assembly according to claim 15, wherein each of said spring segments of said backing plate is 0.625 inch (16 mm) wide;

the spring slot separating said spring segments is 0.062 inch (1.6 mm) wide;

said pawls respectively extend 0.070 inch (1.8 mm), 0.140 inch (3.6 mm) and 0.210 inch (5.4 mm) from said spring segments and at 45-degree angles thereto, the shortest pawl is the closest to said positioning stop;

each of said pawls has an engaging edge to facilitate securing said pawl to a frame member of the window frame assembly;

said positioning stop has an engaging surface to facilitate the positioning of said mounting clip on said window surround assembly;

said engaging edges of said pawls on said first spring segment are respectively 0.218 inch (5.5 mm), 0.342 inch (8.7 mm) and 0.466 inch (11.8 mm) from said engaging surface of said positioning stop;

said engaging edges of said pawls on said second spring section are respectively 0.280 inch (7.1 mm), 0.404 inch (10.3 mm) and 0.528 inch (13.4 mm) from said engaging surface of said positioning stop;

the pawl that extends farthest from said second spring segment is disposed along said second end thereof; and the pawl that extends farthest from the first spring segment is spaced from said second end thereof to provide an intermediate spacing of said pawls disposed on said first spring segment with respect to said pawls disposed on said second spring segment.

17. A window trim assembly according to claim 16, wherein the distance that each of said pawls extends from said backing plate decreases in direct and linear proportion to its distance from said second end of said backing plate.

18. A window trim assembly according to claim 17, wherein said backing plate, said pawls and said positioning stop are one continuous piece.

19. A window trim assembly according to claim 18, wherein said mounting clip is made of plastic.

20. A window trim assembly attachable to a window frame assembly, having a frame member, to trim around and within a structural window opening, the window trim assembly comprising:

a window surround assembly including a surround header, a surround stool and a pair of surround sides, each of said surround sides extending between and being connected at right angles to different ends of said surround header and said surround stool to form a rectangular assembly therewith;

a casing assembly including a casing header, a casing apron and a pair of casing sides, each of said casing sides extending between and being connected at right angles to different ends of said casing header and said casing apron to form a rectangular assembly therewith, said casing assembly being secured to said surround assembly;

a plurality of mounting clips secured to said surround assembly; and a seal connected to said window surround to provide a thermal and a moisture barrier between the window trim assembly and the window frame assembly.

21. A window trim assembly according to claim 20, wherein said seal is an adhesive-backed foam.

22. A mounting clip to secure a preassembled window trim assembly to a window frame assembly having a frame member, the mounting clip comprising:

a resilient backing plate having a mounting portion, to facilitate securing the mounting clip to the window trim assembly, proximate a first end of said backing plate and a spring portion proximate a second end of said backing plate;

a plurality of elongated pawls secured to one side of said spring portion of said backing plate, to facilitate securing the mounting clip to the frame member of the window frame assembly, said pawls being disposed parallel to and spaced from each other and parallel to and proximate said second end of said backing plate, said pawls extending away from said backing plate at an acute angle and in a direction away from said second end of said backing plate, said pawls being spaced from each other a distance greater than the thickness of the frame member of the window frame assembly, each of said pawls being equally spaced from each adjacent pawl, said pawls respectively extending 0.070 inch (1.8 mm), 0.140 inch (3.6 mm) and 0.210 inch (5.4 mm) from said spring portion of said backing plate and at 45-degree angles thereto, the shortest pawl being the closest to said positioning stop, each of said pawls having an engaging edge to facilitate securing said pawl to a frame member of the window frame assembly, said engaging edges of said pawls being respectively 0.280 inch (7.1 mm), 0.404 inch (10.3 mm) and 0.528 inch (13.4 mm) from said engaging surface of said positioning stop, the pawl that extends farthest from said backing plate being disposed along said second end thereof; and a positioning stop secured to said backing plate, to facilitate positioning the mounting clip in preparation for securing the mounting clip to the window trim casing, said positioning stop being disposed parallel to said pawls and proximate a substantially central line separating said spring and mounting portions of said backing plate, said positioning stop extending at substantially right angles from the same side of said backing plate as do said pawls, said positioning stop having an engaging surface to facilitate the positioning of said mounting clip on said window surround assembly.

23. A mounting clip according to claim 22, wherein the distance that each of said pawls extends from said backing plate decreases in direct and linear proportion to its distance from said second end of said backing plate.

24. A mounting clip according to claim 23, wherein said backing plate, said pawls and said positioning stop are one continuous piece.

25. A mounting clip according to claim 24, wherein the mounting clip is made of plastic.

26. A mounting clip to secure a preassembled window trim assembly to a window frame assembly having a frame member, the mounting clip comprising:

a resilient backing plate having a mounting portion, to facilitate securing the mounting clip to the window trim casing, proximate a first end of said backing plate and a spring portion proximate a second end of said backing plate, said spring portion of said backing plate being bifurcated to define a spring slot extending from a substantially central point along said second end of said backing plate to a similar point along a line separating said spring portion from said mounting portion of said backing plate, said spring slot separating said spring portion into, and defining, a first spring segment and a second spring segment, each of said spring segments being 0.625 inch (16 mm) wide, the spring slot separating said spring segments being 0.062 inch (1.6 mm) wide;

a plurality of elongated pawls secured to one side of each of said spring segments of said backing plate to facilitate securing the mounting clip to the frame member of the window frame assembly, said pawls being disposed parallel to and spaced from each other and parallel to and proximate said second end of said backing plate, said pawls extending away from said backing plate at an acute angle and in a direction away from said second end of said backing plate, said pawls being spaced from each other a difference greater than the thickness of the frame member of the window frame assembly, said pawls extending from said first spring segment being disposed at distances from said second end of said backing plate that are intermediate with respect to the distances from said second end of said backing plate at which said pawls extending from said second segment of said spring portion are disposed, each of said pawls extending from each of said segments being equally spaced from each adjacent pawl extending from the same one of said segments, said pawls respectively extending 0.070 inch (1.8 mm), 0.140 inch (3.6 mm) and 0.210 inch (5.4 mm) from said spring segments and at 45-degree angles thereto, the shortest pawl being the closest to said positioning stop, each of said pawls having an engaging edge to facilitate securing said pawl to the frame member of the window frame assembly, said engaging edges of said pawls on said first spring segment being respectively 0.218 inch (5.5 mm), 0.342 inch (8.7 mm) and 0.466 inch (11.8 mm) from said engaging surface of said positioning stop, said engaging edges of said pawls on said second spring section being respectively 0.280 inch (7.1 mm), 0.404 inch (10.3 mm) and 0.528 inch (13.4 mm) from said engaging surface of said positioning stop, the pawl that extends farthest from said second spring segment being disposed along said second end thereof, and the pawl that extends farthest from the first spring segment being spaced from said second end thereof to provide an intermediate spacing of said pawls disposed on said first spring segment with respect to said pawls disposed on said second spring segment; and a positioning stop secured to said backing plate to facilitate positioning the mounting clip in preparation for securing the mounting clip to the window trim casing, said positioning stop being disposed parallel to said pawls and proximate a substantially central line separating said spring and mounting portions of said backing plate, said positioning stop extending at right angles from the same side of said backing plate as do said pawls, said positioning stop having an engaging surface to facilitate the positioning of the mounting clip on said window surround assembly.

27. A mounting clip according to claim 26, wherein the distance that each of said pawls extends from said backing plate decreases in direct and linear proportion to its distance from said second end of said backing plate.

28. A mounting clip according to claim 27, wherein said backing plate, said pawls and said positioning stop are one continuous piece.

29. A mounting clip according to claim 28, wherein the mounting clip is made of plastic.

30. A window trim assembly attachable to a window frame assembly, having a frame member, to trim around and within a structural window opening, the window trim assembly comprising:

a window surround assembly including a surround header, a surround stool and a pair of surround sides, each of said surround sides extending between and being connected at right angles to different ends of said surround header and said surround stool to form a rectangular assembly therewith;

a casing assembly including a casing header, a casing apron and a pair of casing sides, each of said casing sides extending between and being connected at right angles to different ends of said casing header and said casing apron to form a rectangular assembly therewith, said casing assembly being secured to said surround assembly;

a plurality of mounting clips secured to said surround assembly, each of said mounting clips including a resilient backing plate having a mounting portion to facilitate securing said mounting clip to the window trim assembly proximate a first end of said backing plate and a spring portion proximate a second end of said backing plate, a plurality of elongated pawls secured to one side of said spring portion of said backing plate to facilitate securing said mounting clip to a frame member of the window frame assembly, said pawls being disposed parallel to and spaced from each other and parallel to and proximate said second end of said backing plate, said pawls extending away from said backing plate at an acute angle and in a direction away from said second end of said backing plate, said pawls being spaced from each other a distance greater than the thickness of the frame member of the window frame assembly, each of said pawls being equally spaced from each adjacent pawl, said pawls respectively extending 0.070 inch (1.8 mm), 0.140 inch (3.6 mm) and 0.210 inch (5.4 mm) from said spring portion of said backing plate and at 45-degree angles thereto, the shortest pawl being the closest to said positioning stop, each of said pawls having an engaging edge to facilitate securing said pawl to a frame member of the window frame assembly, said engaging edges of said pawls being respectively 0.280 inch (7.1 mm), 0.404 inch (10.3 mm) and 0.528 inch (13.4 mm) from said engaging surface of said positioning stop, the pawl that extends farthest from said backing plate being disposed along said second end thereof; and a positioning stop secured to said backing plate to facilitate positioning said mounting clip in preparation for securing said mounting clip to the window trim casing, said positioning stop being disposed parallel to said pawls and proximate a substantially central line separating said spring and mounting portions of said backing plate, said positioning stop extending at right angles from the same side of said backing plate as do said pawls, said positioning stop having an engaging surface to facilitate the positioning of said mounting clip on said window surround assembly.

31. A window trim assembly according to claim 30, wherein the distance that each of said pawls extends from said backing plate decreases in direct and linear proportion to its distance from said second end of said backing plate.

32. A window trim assembly according to claim 31, wherein said backing plate, said pawls and said positioning stop are one continuous piece.

33. A window trim assembly according to claim 32, wherein said mounting clip is made of plastic.

* * * * *